US005647605A

United States Patent [19]

Arduin

[11] Patent Number: 5,647,605

[45] Date of Patent: Jul. 15, 1997

[54] INTERFACE APPARATUS FOR MODIFYING THE NATURAL DISTRIBUTION PRESSURE OF A SKI SUCH AS IN PARTICULAR AN ALPINE SKI

[75] Inventor: Joël Arduin, Metz-Tessy, France

[73] Assignee: Salomon S.A., Metz-Tessy, France

[21] Appl. No.: 431,430

[22] Filed: May 1, 1995

[30] Foreign Application Priority Data

May 16, 1994 [FR] France ..... 94 06145

[51] Int. Cl.[6] ..... A63L 5/06

[52] U.S. Cl. ..... 280/602; 280/607; 280/634

[58] Field of Search ..... 280/601, 602, 280/607, 11.14, 611, 617, 618, 633, 634

[56] References Cited

U.S. PATENT DOCUMENTS

| | | | |
|---|---|---|---|
| 3,260,532 | 7/1966 | Heuvel | 280/11.13 |
| 4,139,214 | 2/1979 | Meyer | 280/607 |
| 4,288,094 | 9/1981 | Svoboda | 280/634 |
| 4,568,100 | 2/1986 | Eriksson | 280/607 |
| 4,896,895 | 1/1990 | Bettosini | 280/607 |
| 5,135,250 | 8/1992 | Abondance et al. | 280/617 |
| 5,303,950 | 4/1994 | Rigal et al. | 280/607 |
| 5,332,253 | 7/1994 | Couderc et al. | 280/602 |
| 5,397,149 | 3/1995 | Couderc et al. | 280/602 |
| 5,513,872 | 5/1996 | Arduin et al. | 280/602 |
| 5,540,458 | 7/1996 | Arduin et al. | 280/602 |
| 5,566,966 | 10/1996 | Couderc et al. | 280/634 |

FOREIGN PATENT DOCUMENTS

| | | | |
|---|---|---|---|
| 1270867 | 6/1990 | Canada . | |
| 0182776 | 5/1986 | European Pat. Off. . | |
| 0530449 | 3/1993 | European Pat. Off. . | |
| 530449A1 | 3/1993 | European Pat. Off. | 280/602 |
| 567780A1 | 11/1993 | European Pat. Off. | 280/618 |
| 2583296 | 12/1986 | France | 280/633 |
| 2679147 | 1/1993 | France . | |
| 2713325 | 10/1977 | Germany | 280/633 |
| WO93/11838 | 6/1993 | WIPO . | |
| WO93/14837 | 8/1993 | WIPO . | |
| 93015797A1 | 8/1993 | WIPO | 280/618 |

*Primary Examiner*—Brian L. Johnson
*Assistant Examiner*—Min Yu
*Attorney, Agent, or Firm*—Greenblum & Bernstein P.L.C.

[57] ABSTRACT

An interface apparatus between a boot and a ski, to modify the natural distribution of the ski on the snow. The apparatus comprises a first base and a second base affixed to the ski, a first moveable sensor provided to support one end of the sole of the boot and to sense the variations in support force exerted by the boot, and a second moveable sensor adapted to support the second end of the boot and to sense the variations in support force of this end, and linkage extending between the two sensors and the bases, so as to transmit to said bases the variations in support forces sensed by each of the sensors.

14 Claims, 2 Drawing Sheets

INTERFACE APPARATUS FOR MODIFYING THE NATURAL DISTRIBUTION PRESSURE OF A SKI SUCH AS IN PARTICULAR AN ALPINE SKI

BACKGROUND OF THE INVENTION

1. Field of the Invention

The invention relates to an interface apparatus whose object is to modify the natural distribution of pressure of a ski such as, in particular, an alpine ski on its gliding surface.

2. Discussion of Background and Material Information

Skis which are utilized for alpine skiing are constituted by relatively long beams, on which the boots of the skier are retained by front and rear binding elements. The boots and the binding elements are positioned approximately in the median zone of the ski. The skis themselves present, at rest, a natural camber by virtue of the median zone is being raised naturally with respect to the front end of the ski, and the rear end of the ski. Furthermore, skis have a flexibility, which depends upon their internal structure. During skiing, the ski deforms in an elastic manner in response to the different forces to which it is subjected by the skier, but also by virtue of the terrain over which it glides.

Commonly owned European patent publication No. EP 530 449 discloses an interface apparatus which dynamically modifies the distribution of pressure of the ski on the snow as a function of the vertical forces that the skier exerts on his skis. This apparatus comprises a vertically moveable sensor which transmits to the base of the front binding element the vertical forces which it senses originating from the boot. These forces are transmitted by means of a rocking element, and in one of the embodiments, by means of a substantially horizontal linkage plate pivotally connected on one side to the rocking element and on the other side to the base of the binding.

This apparatus gives good results however, it reacts to the variation of the support force of only one part of the sole of the boot.

SUMMARY OF THE INVENTION

One object of the invention to perfect this type of apparatus by making it even more sensitive to the variations of the support force of the sole of the boot on the ski.

Another object of the invention is to suggest an interface apparatus whose dynamic action on the ski can be selected depending upon whether one wants a ski which is more pivotable or a ski which is more guiding, i.e., more stable during movement.

Another object of the invention is to propose an apparatus which is simple to construct.

These objects and others which will appear from the description which follows are resolved by the interface apparatus as has been defined hereinbelow.

The interface apparatus comprises a first base adapted to be affixed to the ski, in the vicinity of a first binding element, a second base adapted to be affixed to the ski in the vicinity of a second binding element, a first moveable sensor provided to support one end of the sole of the boot and to sense the variations in the support force exerted by the boot. The apparatus has a second moveable sensor provided to support the second end of the boot and to sense the variations of the support force of this end, and linkage means extending between the two sensors and the bases, provided to transmit to the bases, the variations of the support forces sensed by the sensors.

The fact that the boot rests in suspension on two sensors makes it possible for the ski to react to the variations in the support force of one or the other of the two front and rear ends of the boot.

Furthermore, depending upon the nature of the linkage means used, the variations of the support forces can result in one or the other ends of the ski being pressed towards the snow, or on the contrary, being lifted away therefrom.

BRIEF DESCRIPTION OF THE DRAWINGS

The invention will be better understood with reference to the description below and the annexed drawings in which.

DETAILED DESCRIPTION OF THE PREFERRED EMBODIMENTS

Figure 1:
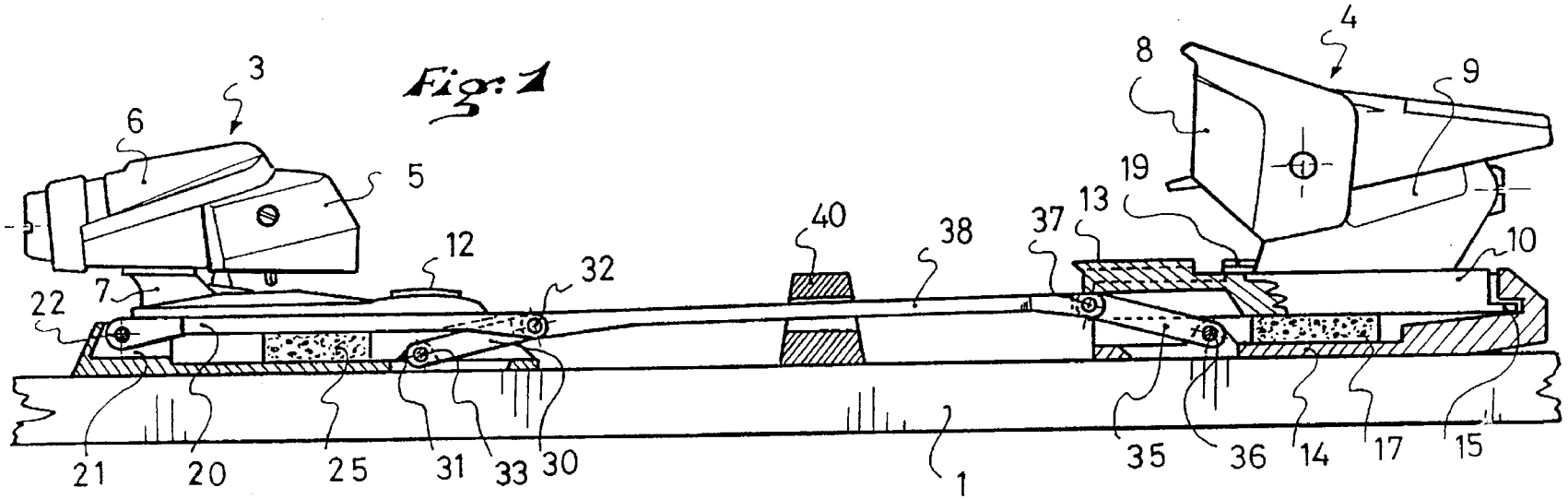
FIG. 1 shows a side view of an apparatus according to a first non-limiting embodiment of the invention.

FIG. 1 shows a ski 1 seen from the side in its median zone. Binding elements 3 and 4 are mounted on a ski in this median zone.

Binding elements 3 and 4 are of any appropriate type. The front binding element 3 has, in an known manner, a jaw 5 for retaining the front end of the boot. The jaw is carried by a body 6, and the body is itself mounted on a base plate 7 through which the binding element is assembled to the ski.

In a similar manner, rear binding element 4 has a jaw 8 carried by a body 9. Body 9 is slidably mounted along a base plate 10 shaped as a slide and oriented in the longitudinal direction of the ski, under the action of a spring known as a return spring, which elastically returns the body towards the front.

To each binding element 3 and 4 is likewise associated a support element 12 and 13 on which the sole of the boot rests. These support elements will be described in greater detail below.

The apparatus includes a first moveable sensor provided to sense the variations in the support force of the boot on the ski. In the embodiment illustrated in FIG. 1, the sensor is formed by support element 13 on which the rear end of the sole of the boot rests. The support element 13 forms the frontward extension of slide 10. It can be integrated with the slide or attached thereto.

The support element is moveable along a substantially vertical direction. In the embodiment illustrated, slide 10 is in effect connected to the ski by means of a base 14 which is affixed to the ski. The slide is pivotally connected to the base around a transverse and horizonal axis located at its rear portion. In the example illustrated, this axis is imaginary, and it is materialized by the collaboration of lugs 15 positioned on the rear of the slide, such lugs cooperating with complementary housings of base 14. Any other appropriate means may be used.

The housing of slide 10 in base 14 is slightly hollowed out in a vertical direction on the front side of the slide. Preferably, the rear of slide 10 is maintained without vertical clearance in the base, in the area of lugs 15.

Preferably, a block of elastically deformable material 17 maintains the front portion of the slide raised in its housing of the base. Block 17 can have shock absorption properties.

Preferably, an abutment limits the upward path of the slide. This abutment is, for example, formed by two folds 19 of the lateral edges of base 14.

However, in a normal position, there can exist a vertical clearance between the slide and abutment 19.

Thus, slide 10 can oscillate in its housing of base 14, under the effect of the vertical forces applied to support element 13. The downward movements of the base plate causes the compression of block 17.

Likewise, front support element 12 forms a second sensor provided to sense the variations in the support force that the front of the boot exerts on the ski.

Front element 3 is connected to the ski by a plate 20 whose front portion is pivotally connected at axis 22 to a base 21 solidly affixed to the ski.

Support element 12 is positioned at the rear portion of plate 20.

Plate 20 is maintained raised with respect to the upper surface of the ski by a block of elastically deformable material 25. Possibly, block 25 could have shock absorption properties.

Preferably, an abutment limits the upward rotational movement of plate 20. This abutment is, for example, formed by wings 26 affixed to the ski and positioned at the rear portion of base 20, whose end is folded above the base plate.

Thus, support element 12 can oscillate along a vertical direction around axis 22 as a function of the support forces exerted by the front end of the sole of the boot. The movements cause the compression of block 25.

In addition, the linkage assembly connect the two sensors 12 and 13 to bases 14 and 21.

This assembly comprises plate 20 for support element 12, and slide 10 for support element 13. These two elements are pivotally connected respectively to base 21 and base 14 which are themselves, solidly affixed to the ski.

The linkage assembly further comprise connecting rods or rocking elements, or other appropriate means whose arrangement depends upon the effect desired on the bending of the ski.

Figure 2:
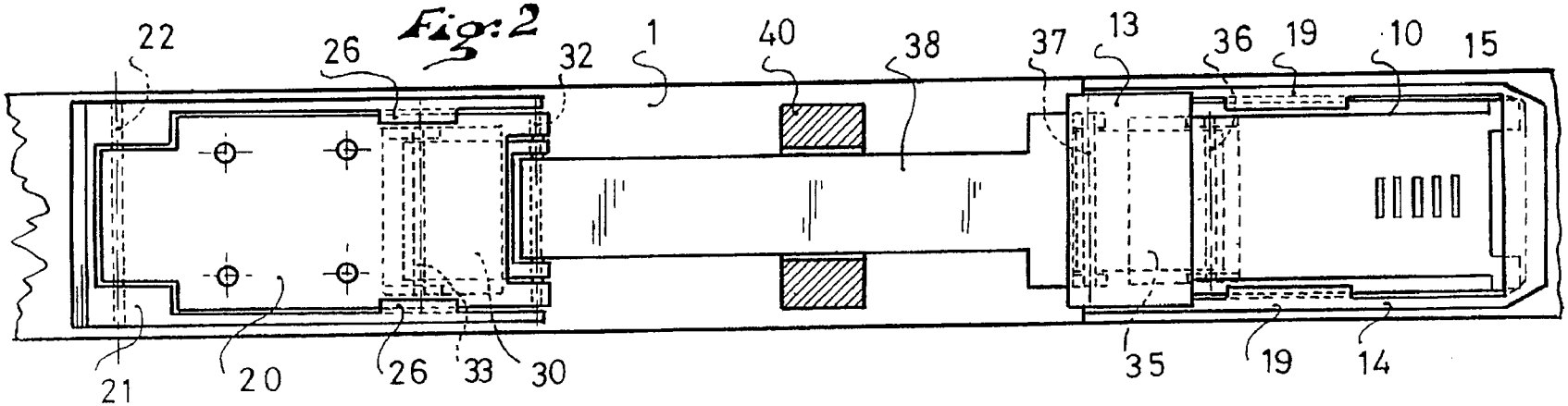
FIG. 2 is a top view of the apparatus of FIG. 1.

In the embodiment shown in FIGS. 1 and 2, the linkage assembly comprises, for the front binding element, a connecting rod 30 which is pivotally connected by to the rear portion of plate 20 and to a bearing 31 affixed to the ski. Wings 26 for vertical retention which were previously discussed can be solidly affixed to bearing 31.

The pivot axis between the connecting rod and the plate is schematically shown at 32 and that with bearing 31 is schematically shown at 33. Preferably, axis 33 is positioned lower with respect to the ski than is journal axis 22 between plate 20 and base 21.

Bearing 31 is positioned in front with respect to the rear portion of plate 20, and as a result, connecting rod 20 is inclined from front to rear and from bottom to top.

Connecting rod 30 maintains the rear end of plate 20 suspended above the upper surface of the ski, in cooperation with block 25.

Taking into account the configuration of the structure thus formed by plate 20, the ski and connecting rod 30, a downward bias exerted by the boot on sensor 12 tends to make axis 32 retract, and to exert on base 21, by means of axis 22, a rearward bias, which translates in the ski, into a bending moment which tends to lift its front end. It is known that such a bending moment tends to render the ski momentarily more pivotable or steerable. That is to say, that the tendency of the ski to pivot is improved as a result of a lightening of the pressure that the front end of the ski exerts on the snow.

The linkage assembly further comprises towards the rear, a connecting rod 35. This connecting rod is journalled in its lower portion to base 14 or to an element affixed to the ski, around an axis 36. The upper portion of connecting rod 35 is pivotally connected at axis 37 to a pressure bar 38 which extends frontwardly, and whose front end is connected to axis 32 between connecting rod 30 and plate 20.

The rear connecting rod 35 is oriented in an inclined manner from front to rear and from top to bottom.

Sensor 13 is simply supported on connecting rod 35, in the area of its pivot axis with pressure bar 38.

A downward force exerted on sensor 13 is transformed by connecting rod 35 into a horizontal force directed towards the front and transmitted to the front structure by the pressure bar 38. Such a force has the reverse effect of the force previously described, i.e., it causes a bending moment which tends to press the front end of the ski against the snow. The reaction of the horizontal force transmitted by the pressure bar is taken up by rear base 14, in the area of axis 36. This reaction tends to press the rear end of the ski against the snow.

It is known that such bending moments exerted on the front end of the ski, and where necessary, on its rear end, make the ski more guidable, i.e., more stable over its trajectory. In effect, the pressure of the ski on the snow is momentarily offset frontwardly, and when necessary, towards the rear of the ski.

In the case where it is front sensor 12 which is biased by a variation of the support force of the boot, the deformation of the front structure also exerts an influence on the pressure bar 38 and tends to make the pressure bar and the connecting rod 35 retract. As the sensor 13 is simply supported on connecting rod 35, the pressure bar, in retracting, tends to raise sensor 13. Depending upon the position of slide 10 with respect to abutment 19, this movement is prevented or allowed. Preferably, initially, abutment 19 is disengaged above slide 10 to allow the slide to rise under this circumstance. As a result, the reaction caused in the ski by the retraction of the pressure bar is not significant. If desired, an elastic pad is wedged between slide 10 and abutment 19 to absorb the retraction of bar 38.

Thus, the embodiment which has just been described has two different effects on the ski depending upon whether it is the sensor 12 or 13 which is biased by the boot, i.e., in fact depending upon whether the skier places his weight forwardly or rearwardly on the ski.

The respective amplitudes of these different effects depend upon the height of the different axes with respect to the upper surface of the ski, on the inclination of the connecting rods and on their length. This is within the scope of one skilled in the art.

Alternatively, a support member 40 is positioned on the ski between the front and rear sensors 12 and 13. This member 40 is adapted to support the central zone of the sole of the boot. It has a central recess of appropriate dimensions for the passage of the pressure bar.

Thus, the variations of the support force of the sole of the boot are produced either on the front sensor, or on the rear sensor, and cannot occur simultaneously on both sensors by virtue of the support member which forms a sort of transverse and central journal around which the sole of the boot rocks. The support member 40 can be adjustable in height. It can also be placed nearer to one sensor than the other.

Figure 3:
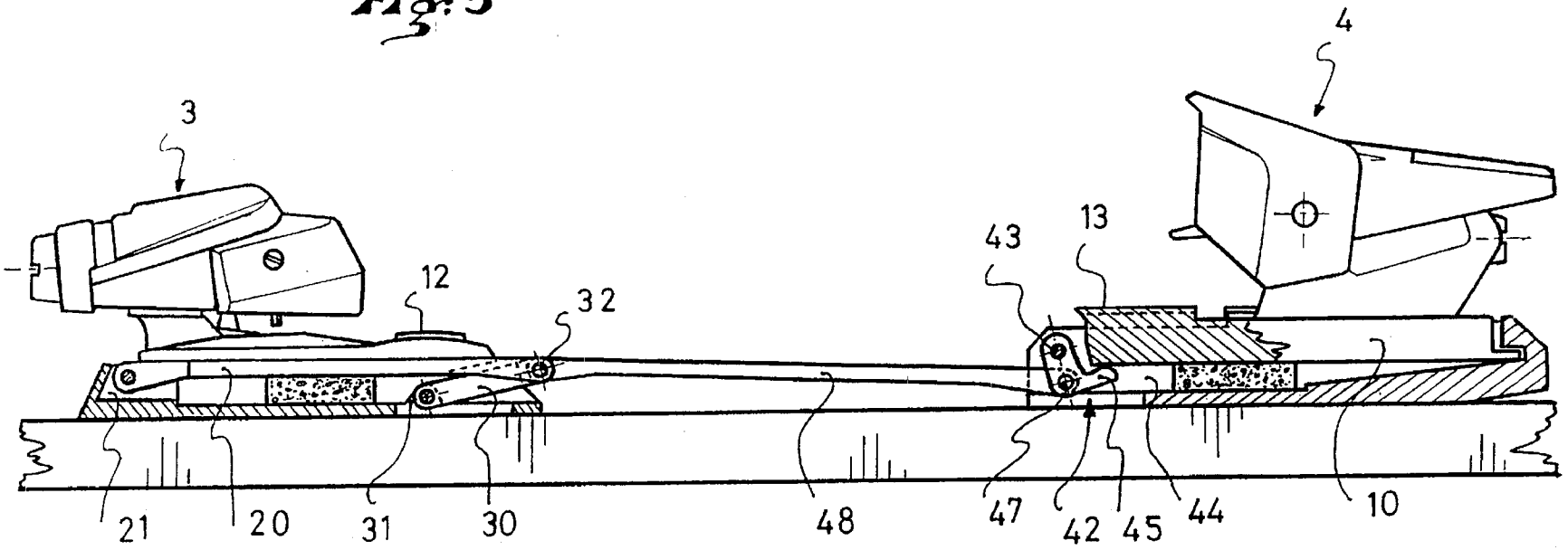
FIG. 3 relates to an alternative embodiment of the invention.

FIG. 3 shows an alternative embodiment. According to this embodiment, the front structure is of the same type as in the preceding case, with plate 20 connected to the ski by the base 21 on one side, the connecting rod 30 and bearing 31 on the other. Towards the rear, the preceding connecting rod 35 is replaced by a rocking element 42 pivotally mounted around a transverse axis 43 which is carried by the lateral wings of base 44 of the rear binding element. The rocking element has towards the rear an approximately horizontal arm 45 which is engaged under slide 10, in the area of sensor 13. Under the axis 43, the rocking element has a second transverse axis 47 for a pressure bar 48 similar to the preceding one, whose other end is connected to at pivot axis 32 which connects it to connecting rod 30.

This embodiment variation functions substantially in the same manner as the preceding embodiment, the role of connecting rod 35 being filled here by rocking element 42.

The boot is supported on the ski by two suspended supports which sense the support force that the boot exerts on each of them. The variations in the support force exerted by the boot on one or the other of these supports are transmitted to the ski where they cause a dynamic effect on the bending of the ski.

The linkage between the sensors and the bases affixed to the ski is determined as a function of the pivotable or guiding effect that one desires to bring about in the ski whilst varying the support of the front or the rear of the boot.

It is self-evident that other means can be appropriately used instead of rocking element 42. Likewise, front connecting rod 30 can be replaced by a rocking element 42 or other appropriate means.

The invention is not limited to the embodiments which have been described. In particular, the effects exerted on the ski by the support variations of the front and rear sensors can be different, and notably reversed by a reverse inclination of connecting rods 30 and 35, or by an inversion of axes 43 and 47 of the rocking element. Furthermore, in the embodiments described, the effects on the bending of the ski are manifested principally at the front end of the ski. This is not limiting either, and one can just as well exert these forces more directly on the rear end.

The instant application is based upon French patent application 94.06145 of May 16, 1994, the disclosure of which is hereby expressly incorporated by reference thereto, and the priority of which is hereby claimed.

Although the invention has been described with reference to particular means, materials and embodiments, it is to be understood that the invention is not limited to the particular means disclosed and extends to all other means, materials and embodiments falling within the scope of the claims which follow.

What is claimed is:

1. An interface apparatus adapted to be positioned between a boot and a ski for modifying a natural pressure distribution of a ski on the snow, the ski being adapted to be equipped with a first binding element and a second binding element for retaining a boot upon the ski, said interface apparatus comprising:

a first base adapted to be affixed to the ski in the vicinity of the first binding element;

a second base adapted to be affixed to the ski in the vicinity of the second binding element;

a first sensor adapted to support a first end of a sole of the boot and to sense changes in a downwardly directed support force exerted by the first end of the sole of the boot;

a first means for mounting said first sensor for downward movement in response to exertion of said downwardly directed support force exerted by the first end of the sole of the boot;

a first linking arrangement connecting said first sensor to one of said first base and said second base, said first linking arrangement comprising means for applying a bending moment to the ski tending to force one end of the ski to flex in response to the downwardly directed support force exerted by the boot on said first sensor;

a second sensor adapted to support a second end of the sole of the boot and to sense changes in a downwardly directed support force exerted by the second end of the sole of the boot, said second sensor being longitudinally spaced apart from said first sensor;

a second means for mounting said second sensor for downward movement in response to exertion of said downwardly directed support force exerted by the second end of the sole of the boot;

a second linking arrangement connecting said second sensor to the other of said first base and said second base, said second linking arrangement comprising means for applying a bending moment to the ski tending to force the other end of the ski to flex in response to the downwardly directed support force exerted by the boot on said second sensor; and an interconnection between said first linking arrangement and said second linking arrangement.

2. An interface apparatus according to claim 1, wherein:

a plate is pivotally connected to said second base about a transverse and horizontal axis at one end portion of said plate; and said second sensor is fixed upon a second end portion of said plate, said second end portion of said plate being longitudinally opposite said first end portion of said plate.

3. An interface apparatus according to claim 2, wherein:

at least one abutment is affixedly connected to said second base, said at least one abutment being positioned for engaging and limiting upward movement of said plate.

4. An interface apparatus according to claim 1, wherein:

a slide is pivotally connected to said first base about a transverse and horizontal axis at one end portion of said slide; and said first sensor is fixed upon a second end portion of said slide, said second end portion of said slide being longitudinally opposite said first end portion of said slide.

5. An interface apparatus according to claim 4, wherein:

at least one abutment is affixedly connected to said first base, said at least one abutment being positioned for engaging and limiting upward movement of said slide.

6. An interface apparatus according to claim 2, wherein:

said interconnection between said first linking arrangement and said second linking arrangement comprises a pressure bar, said pressure bar having a first end pivotally connected to said plate and a second end operatively connected to said first sensor for transmitting a longitudinal force in response to exertion of said downwardly directed support force on said first sensor.

7. An interface apparatus according to claim 6, wherein:

said second end of said pressure bar is connected to said first sensor via a rocking element, said rocking element being mounted with respect to said first base for pivotal movement about a horizontal and transverse axis.

8. An interface apparatus according to claim 6, wherein:

said second end of said pressure bar is connected to an obliquely extending connecting rod via a pivotal connection, said connecting rod is connected with respect to said first base for pivotal movement about a horizontal and transverse axis; and said first sensor is supported for vertical movement upon said pivotal connection between said pressure bar and said connecting rod.

9. An interface apparatus according to claim 1, further comprising:

a support member positioned between said first sensor and said second sensor, said support member being adapted to be affixed to the ski and to support a central portion of the sole of the boot.

10. An interface apparatus according to claim 1 in combination with a front binding element and a rear binding element.

11. An interface apparatus according to claim 1 in combination with said ski.

12. An interface apparatus according to claim 1, wherein:

said second means for mounting said second sensor for downward movement comprises means for mounting said second sensor for downward movement independent of said first means for mounting said first sensor for downward movement.

13. An interface apparatus for modifying the natural pressure distribution of an alpine ski along a sliding surface of the ski, the ski being adapted to have mounted thereon a front binding element and a rear binding element for retaining a boot upon the ski, said interface apparatus comprising:

a front base adapted to be affixed to the ski in the vicinity of the front binding element;

a rear base adapted to be affixed to the ski in the vicinity of the rear binding element;

a front sensor adapted to support a front end of a sole of the boot, said front sensor being mounted for vertical movement and for capturing vertical forces exerted by said front end of the sole of the boot;

a rear sensor adapted to support a rear end of a sole of the boot, said rear sensor being mounted for vertical movement and for capturing vertical forces exerted by said rear end of the sole of the boot;

an arrangement for linking said front sensor, said rear sensor, said front base, and said rear base, said arrangement comprising:

a front linking assembly connecting said front sensor to said front base, said front linking assembly being operative to exert a longitudinal force with respect to said front base in response to a downward force exerted by the boot upon at least one of said front sensor and said rear sensor;

a rear linking assembly connecting said rear sensor to said rear base, said rear linking assembly being operative to exert a longitudinal force with respect to said rear base in response to a downward force exerted by the boot upon at least one of said front sensor and said rear sensor; and a pressure member extending longitudinally between said front linking assembly and said rear linking assembly and being operative to transfer a downward force exerted by either of said front sensor and said rear sensor to a longitudinal force extending along said pressure member to at least one of said front base and said rear base tending to cause the ski to flex.

14. An interface apparatus for modifying the natural pressure distribution of an alpine ski along a sliding surface of the ski, the ski being adapted to have mounted thereon a front binding element and a rear binding element for retaining a boot upon the ski, said interface apparatus comprising:

a front base adapted to be affixed to the ski in the vicinity of the front binding element;

a rear base adapted to be affixed to the ski in the vicinity of the rear binding element;

a front sensor adapted to support a front end of a sole of the boot, said front sensor being mounted for vertical movement and for capturing vertical forces exerted by said front end of the sole of the boot;

a rear sensor adapted to support a rear end of a sole of the boot, said rear sensor being mounted for vertical movement and for capturing vertical forces exerted by said rear end of the sole of the boot;

an arrangement for linking said front sensor, said rear sensor, said front base, and said rear base, said arrangement comprising:

means for exerting a force on a front part of said front base for generating a bending moment for raising a front of the ski in response to a downward force exerted by the front end of the sole of the boot upon said front sensor; and means for exerting a force on a front part of said front base for generating a bending moment for lowering the front of the ski in response to a downward force exerted by the rear end of the sole of the boot upon said rear sensor.

* * * * *